US006668823B1

(12) United States Patent
Liu

(10) Patent No.: US 6,668,823 B1
(45) Date of Patent: Dec. 30, 2003

(54) DIVING MASK ALLOWING BREATH OF A USER WITH THE NOSE

(76) Inventor: Wen-Ho Liu, No. 78, Lane 11, Huacheng Rd., Hsinchuang City, Taipei Hsien (TW)

( * ) Notice: Subject to any disclaimer, the term of this patent is extended or adjusted under 35 U.S.C. 154(b) by 0 days.

(21) Appl. No.: 10/329,678

(22) Filed: Dec. 27, 2002

(51) Int. Cl.[7] ..... B63C 11/16
(52) U.S. Cl. ..... 128/201.11; 128/201.27
(58) Field of Search ..... 128/201.11, 200.29, 128/201.12, 201.22, 201.23, 201.24, 201.26, 201.27, 201.28, 201.29, 205.24, 206.29, 206.28, 207.12, 107.11; 405/186, 187

(56) References Cited

U.S. PATENT DOCUMENTS

| | | | | | |
|---|---|---|---|---|---|
| 2,317,237 | A | * | 4/1943 | Wilen | 128/201.11 |
| 2,725,876 | A | * | 12/1955 | Maille | 128/201.11 |
| 2,780,224 | A | * | 2/1957 | Wallace | 128/207.11 |
| 3,345,984 | A | * | 10/1967 | Katehis | 128/201.11 |
| 4,269,182 | A | * | 5/1981 | Le | 128/201.11 |
| 5,027,805 | A | * | 7/1991 | Kung | 128/201.11 |
| 5,199,421 | A | * | 4/1993 | Figgiani et al. | 128/201.11 |
| 5,606,967 | A | * | 3/1997 | Wang | 128/201.11 |
| 6,073,626 | A | * | 6/2000 | Riffe | 128/201.11 |
| 6,318,363 | B1 | * | 11/2001 | Monnich | 128/201.11 |
| 6,435,178 | B1 | * | 8/2002 | Lin | 128/201.27 |
| 6,478,024 | B1 | * | 11/2002 | White, Jr. | 128/201.11 |
| 2001/0013346 | A1 | * | 8/2001 | Lemke | 128/201.11 |

* cited by examiner

*Primary Examiner*—Weilun Lo
*Assistant Examiner*—Teena Mitchell
(74) *Attorney, Agent, or Firm*—Rabin & Berdo, P.C.

(57) ABSTRACT

A snorkel diving mask allowing nasal breathing of a user includes a mask body having a pair of transparent portions for the eyes, a nose portion situated between the transparent portions, a resilient peripheral edge for watertight engagement with the facial skin of the user around the eyes and the nose, and a head band for maintaining the watertight engagement of the resilient peripheral edge with the facial skin. The diving mask further has a pair of air admitting hoses extending from opposite side areas of the mask body, an air exiting hose extending from the nose portion of the mask body (10), and a breather in connection and in fluid communication with the hoses. Therefore, the user can breathe in and out nasally when the breather is above the surface of water.

8 Claims, 5 Drawing Sheets

DIVING MASK ALLOWING BREATH OF A USER WITH THE NOSE

BACKGROUND OF THE INVENTION

1. Field of the Invention

The present invention relates to a diving mask and, more particularly, to a snorkel mask which allows nasal breathing.

2. Description of Related Art

Snorkel masks have long been popular because of providing a simple and cheap way to see underwater clearly when swimming. However, the main drawback of the conventional snorkel mask is that the breathing tube fits in the mouth and so the diver can only breathe through the mouth. This often feels unnatural and unhygienic, and so many people are put off this fascinating sport. The unaccustomed manner of breathing with the mouth, instead of the nose, not only makes a negative effect on respiration efficiency but also brings about muscle strain around the mouth, as well as making the diver thirsty or dry in the throat.

Therefore, it is an objective of the invention to provide a diving mask to mitigate and/or obviate the aforementioned problems.

SUMMARY OF THE INVENTION

The object of the present invention is to provide a diving mask which allows nasal breathing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
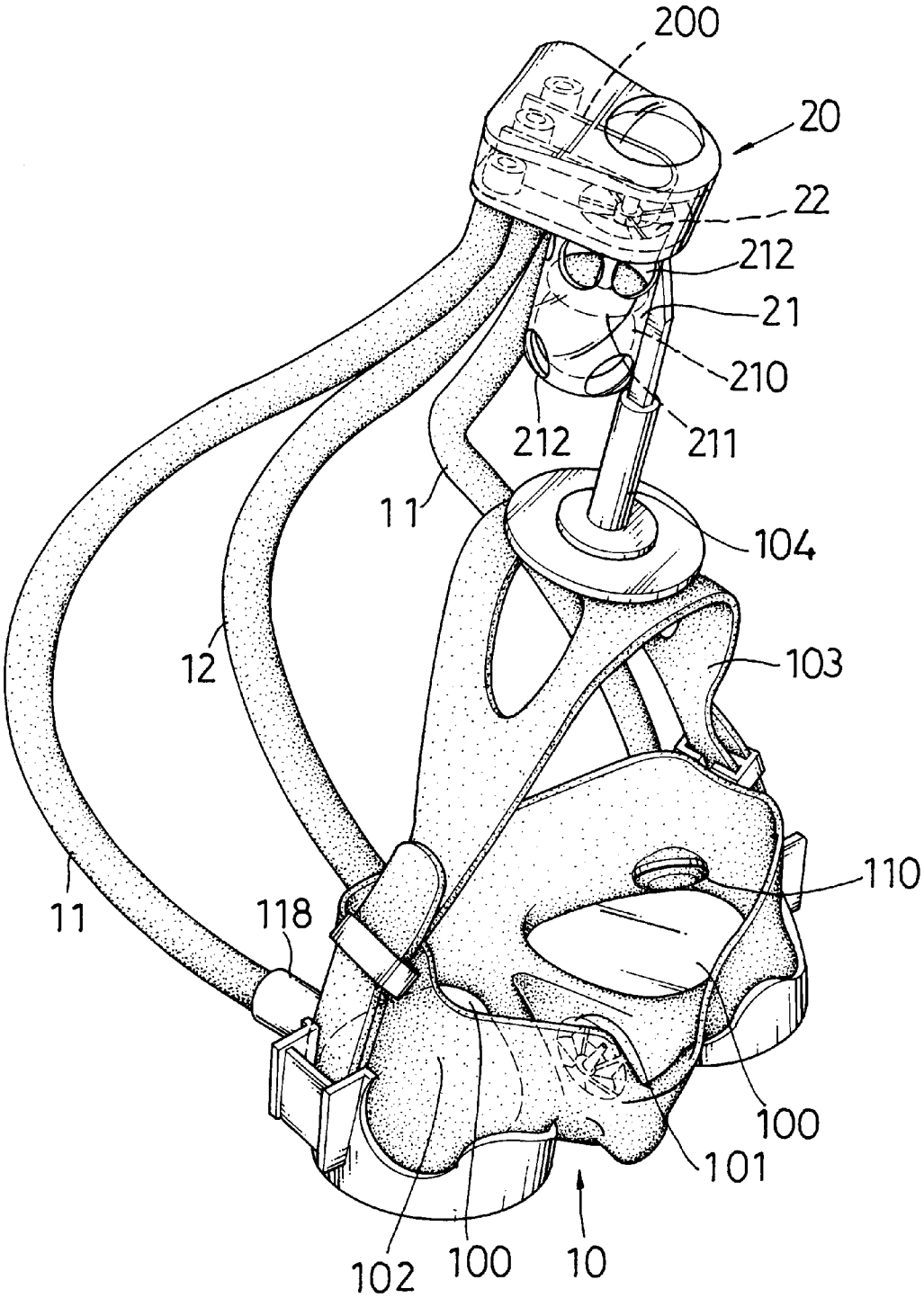
FIG. 1 is an exploded perspective view of a preferred embodiment of a diving mask in accordance with the present invention.

Referring to FIG. 1, a preferred embodiment of a diving mask in accordance with the present invention includes a mask body (10) having a pair of transparent portions (100) for permitting vision of a user and a concave nose portion (101) situated between the two portions (100).

Figure 3:
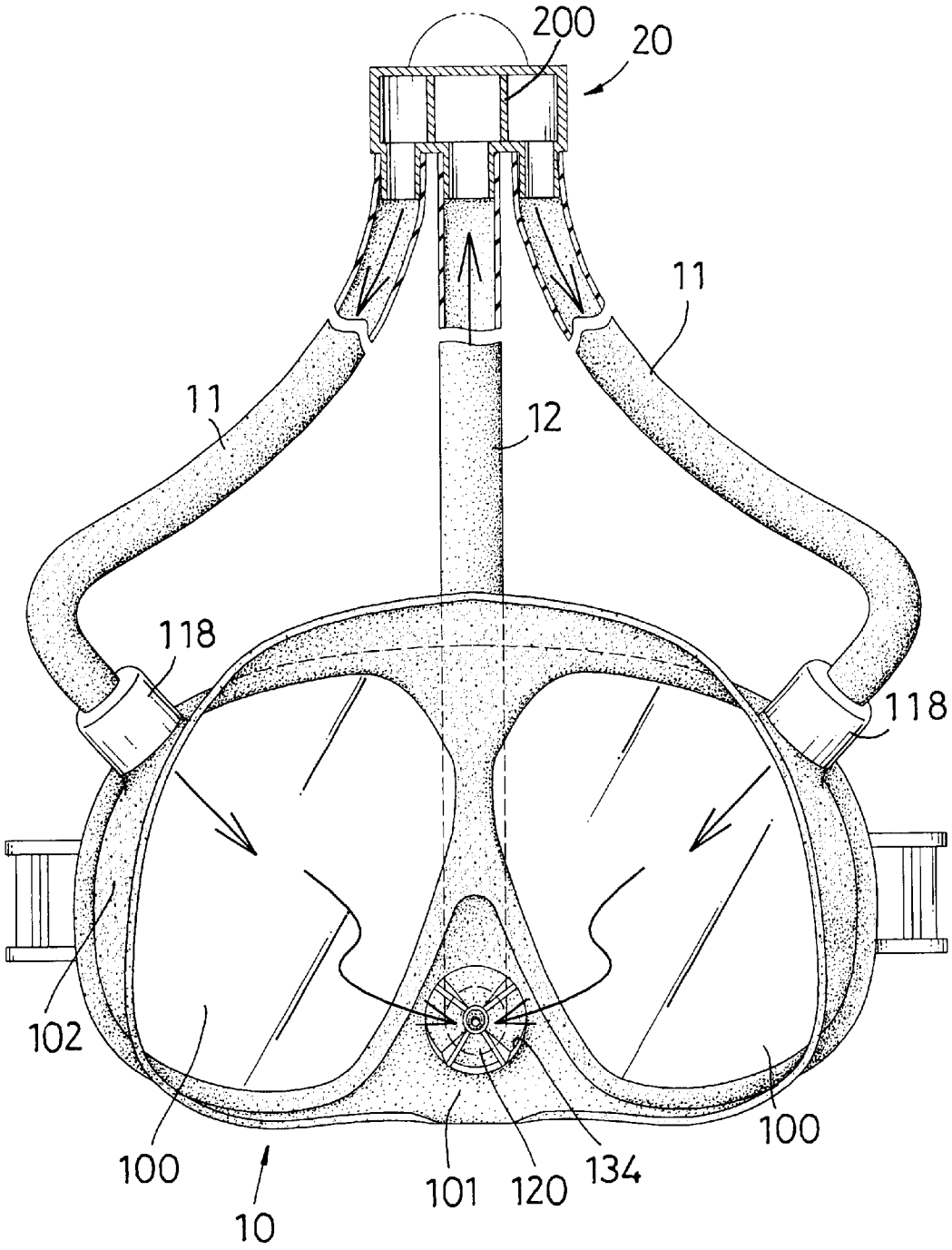
FIG. 3 is a perspective back view of the diving mask of FIG. 1, showing respective directions in which air comes into and exits from an inside of the mask body.

Furthermore, the mask body (10) is formed with a resilient peripheral edge (102), as best shown in FIG. 3, for watertight engagement with the facial skin of the user in a region around the eyes and the nose, and with a head band (103) dimensioned to elastically extend round the head of the user for maintaining the watertight engagement of the resilient peripheral edge (102) with the facial skin. The resilient peripheral edge (102) may be made from a material such as rubber.

The diving mask further includes a pair of air admitting hoses (11) extending from opposite side areas of the mask body (10) and an air exiting hose (12) extending from the nose portion (101) of the same body (10). These hoses (11, 12) are in connection and in fluid communication with a breather (20), which is preferably attached to the mask body (10) by means of a connector (104), as shown in FIG. 4, that extends from the head band (103).

Figure 4:
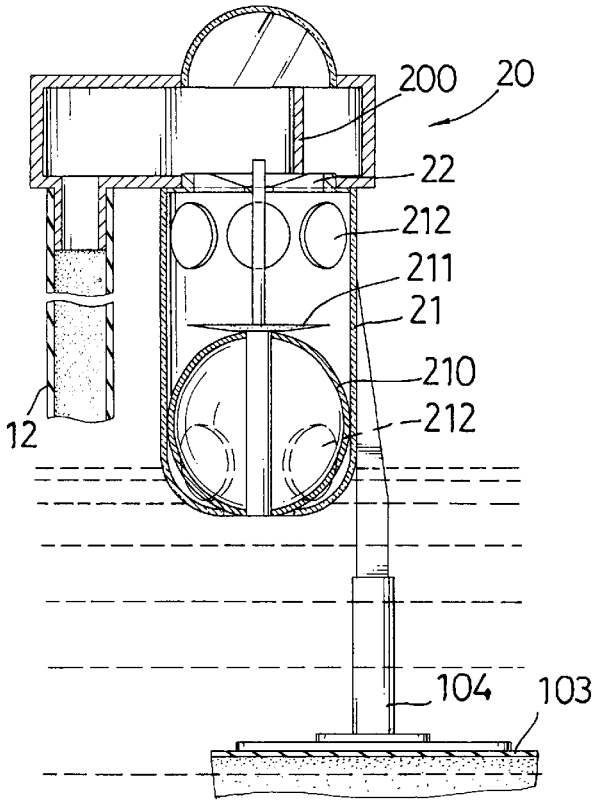
FIG. 4 is a sectional view of a breather included in the diving mask of FIG. 1, showing the breather emerged from water and a float therein falling to its lower position.

As illustrated in FIGS. 1 and 4, the breather (20) is configured into a hollow body provided with a lower frame (21). The hollow body has a bottom orifice (22) in fluid communication with the interior of the lower frame (21) and the lower frame (21) has a plurality of vents (212) open to the exterior of the frame (21), thereby enabling the hoses (11, 12) to be in fluid communication with the exterior of the breather (20).

Figure 5:
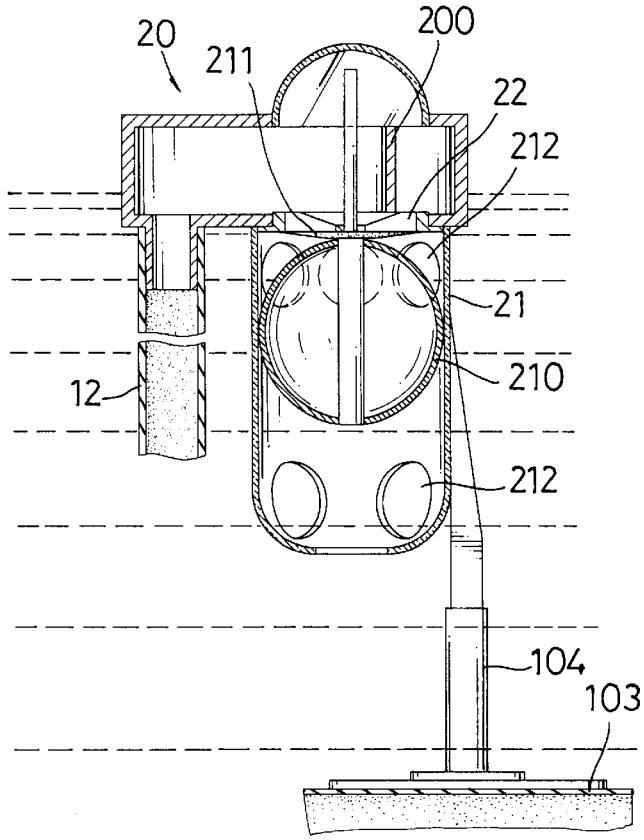
FIG. 5 is a sectional view similar to FIG. 4, but showing the breather submerged into water and the float lifted to its upper position.

The lower frame (21) is specially provided for receiving a movable float (210) which has a top flap (211) to selectively close and open the bottom orifice (22) of the hollow body, as shown in FIGS. 4 and 5.

The breather (20) preferably has an inner partition (200) dividing the interior of the hollow body into a first chamber in fluid communication with the air admitting hoses (11) and a second chamber in fluid communication with the air exiting hose (12). Particularly, the inner partition (200) is arranged in such a way that both of the chambers are in fluid communication with the bottom orifice (22), and so exhaled air coming from the air exiting hose (12) can be discharged from the breather (20) without entering the air admitting holes (11).

Figure 2:
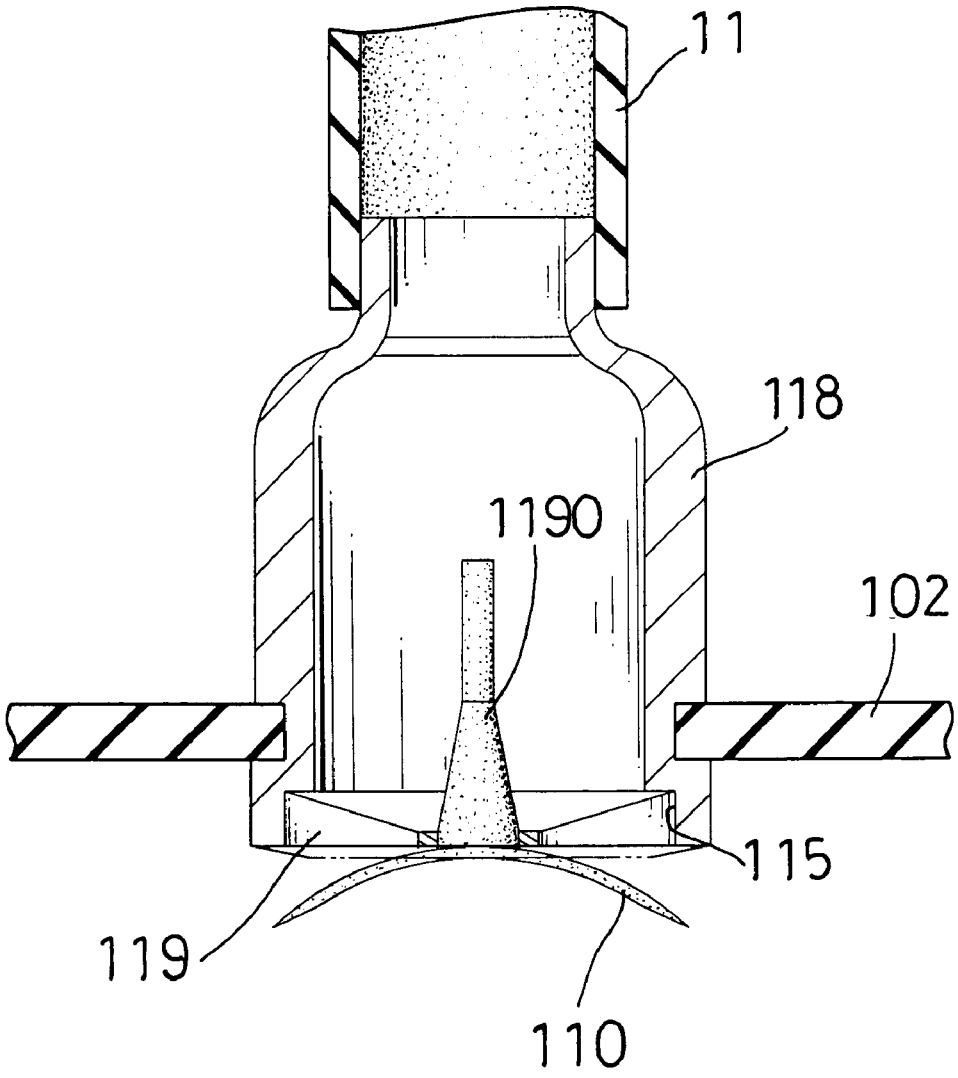
FIG. 2 is a broken sectional view of the diving mask of FIG. 1, showing an air admitting hose affixed to a mask body.

Referring to FIGS. 2 and 3, the mask body (10) has a pair of inlet ports (115) defined in the opposite side areas at where the air admitting hoses (11) are affixed to the mask body (10). In the illustrated embodiment, each of the inlet ports (115) is defined by a tubular fitting (118) that affixes one of the air admitting hoses (11) to the mask body (10).

As clearly shown in FIG. 2, each fitting (118) has an inner end formed with a plurality of radial ribs (119) that support a mounting post (1190) in the center of the inlet port (115). Arranged in the inlet port (115) and fastened to the mounting post (1190) is an inlet valve flap (110) to selectively close and open the inlet port (115) in such a way that air can pass through the port (115) only in a single direction from the air admitting hose (11) to the inside of the mask body (10), i.e. in a direction as designated by outer arrows in FIG. 3.

Referring to FIG. 3, the mask body (10) additionally has an outlet port (134) defined in the nose portion (101) at where the air exiting hose (12) is affixed to the mask body (10), with an outlet valve flap (120) arranged in the outlet port (134) to selectively close and open the same port (134).

The outlet valve flap (120) is arranged in the outlet port (134) in a manner similar to the inlet valve flap (110), but allows air to pass through the outlet port (134) only in a single direction from the inside of the mask body (10) to the air exiting hose (12), i.e. in a direction as designated by a central upper arrow in FIG. 3.

Referring back to FIGS. 1, 2 and 3, the inventive diving mask can be worn by engaging the resilient peripheral edge (102) with the facial skin of the user, with the transparent portions (100) in front of a user's eyes, the nose portion (101) covering the user's nose and the head band (103) extending round the back of the user's head. Being attached by the connector (104), the breather (20) is then positioned behind the head of the user.

With the inventive diving mask, the user can breathe in and out nasally when the breather (20) is above the water surface, for example, when the user has emerged or is swimming immediately under the water surface. As the user is breathing in, air comes into the breather (20) and the air admitting hoses (11), thus moving the inlet valve flaps (110) which then open the inlet ports (115), as shown in FIG. 2. As a result, air comes into the inside of the mask body (10), through the opened inlet ports (115), thereby providing fresh air for the user to inhale nasally.

As the user is breathing out, the exhaled air from the user's nose will move the outlet valve flap (120) which then opens the outlet port (134), and so the exhaled air may come into the air exiting hose (12) through the opened outlet port (134) and may be discharged from the breather (20) via the bottom orifice (22) and the vents (212), as best shown in FIG. 1.

During the period when the user is breathing out, the inlet valve flaps (110) move to close the inlet ports (115) and so the exhaled air can not come into the air admitting hoses (11). Similarly, during the period when the user is breathing in, the outlet valve flap (120) moves to close the outlet port (134) and so residual exhaled air in the air exiting hose (12) can not come to the inside of the mask body (10). The alternate movements of the inlet and outlet valve flaps (110, 120) enables a perfect exchange of air between the inside of the mask body (10) and the environment.

Referring to FIGS. 4 and 5, the user may also dive deep into the water after having taken a deep breath. Being submerged in the water, the float (210) is lifted within the lower frame (21), by the buoyancy, from its lower position as shown in FIG. 4 to its upper position as shown in FIG. 5. It is in the upper position of the float (210) that the top flap (211) closes the bottom orifice (22) and prevents water from coming into the inside of the mask body (10) through the air admitting hoses (11).

The user can breathe immediately once emerged from the water, after a slight nasal breathing-out. The exhaled air from the nose will disengage the top flap (211) from the hollow body and will make the float (210) fall to its lower position, so that the bottom orifice (22) of the breather (20) is opened again.

Figure 6:
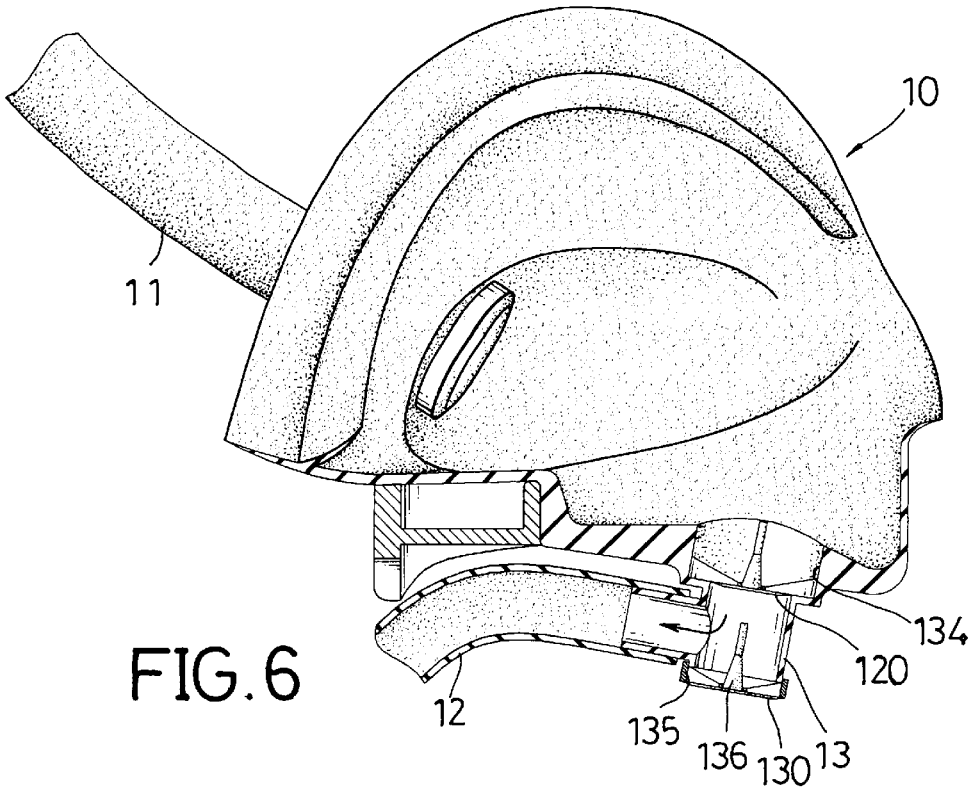
FIG. 6 is a perspective side view, partially broken away, of the diving mask of FIG. 1, showing a drainer in its closed position.
Figure 7:
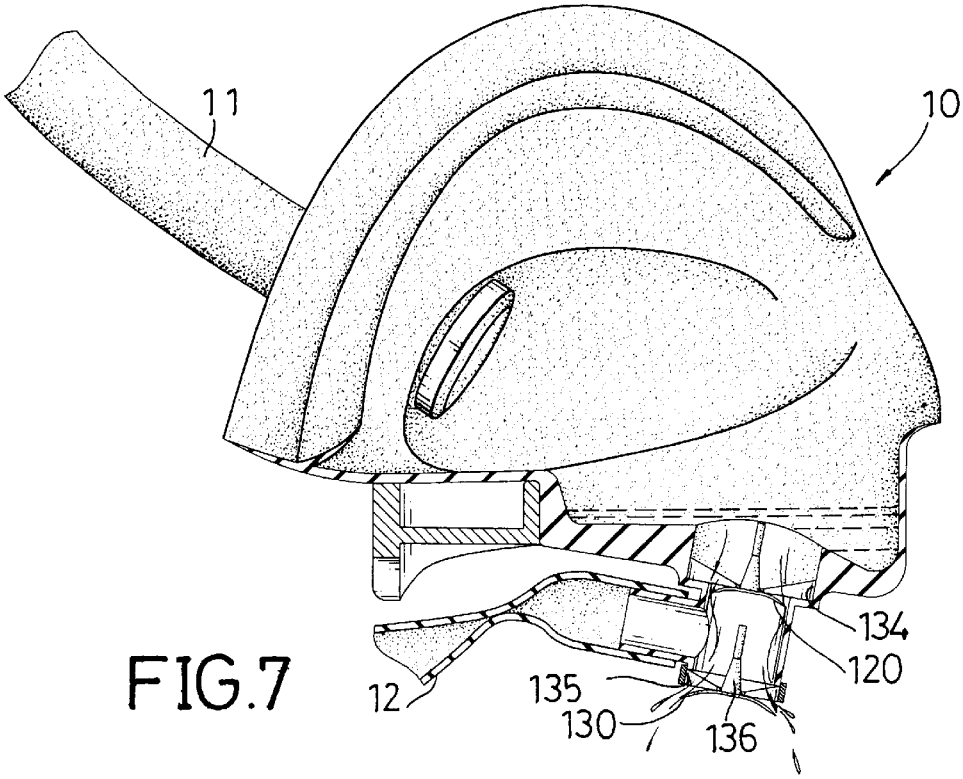
FIG. 7 is a perspective side view similar to FIG. 6, but showing the drainer in its opened position for drainage.

Referring to FIGS. 6 and 7, a drainer (13) is preferably formed on an outside of the mask body (10) oppositely to the outlet valve flap (120), for the purpose of draining out water possibly accumulating within the concave nose portion (101) of the mask body (10).

In detail, the drainer (13) has an opening (135) defined in a wall thereof and a mounting rod (136) situated in a center of the opening (135), with a water-exiting flap (130) fastened to the mounting rod (136) to selectively close and open the opening (135) in such a way that water can pass through the opening (135) only in a single direction from the interior to the exterior of the drainer (13).

If there is a little amount of water undesirably leaked into the inside of the mask body (10), it usually runs to the concave nose portion (101) because most divers swim facing down. During process of the repeated breathing-out of the user, the water is brought to the drainer (13) by the exhaled air and finally accumulates there.

The user can remove the accumulated water from the drainer (13) simply by breathing out strongly by nose while squeezing the air exiting hose (12). The strong pressure from the nose moves the water-exit flap (130) to open the opening (135) and carries the water out of the drainer (13). Such removals avoid the possibility of the accidental entrance of the water into the nose of user while breathing in.

A comparison between the inventive diving mask and the prior art is made in TABLE 1.

TABLE 1 comparison between this inventive mask and the prior art

| | Prior Art | This Invention |
|---|---|---|
| Configuration | in a separate relationship between the mask body and the breathing tube. | in a connected relationship between the hoses and the mask body. |
| Usage | by wearing the mask body on the head in addition to holding the separate tube in the mouth. | by wearing the inventive diving mask on the head only. |
| Breathing | with the mouth. | with the nose in a normal way. |
| Air passage | the single tube both for inhaling and for exhaling. | the air admitting hoses for inhaling and the air exiting hose for exhaling. |
| Air exchange | only between the tube and the mouth. | between the different hoses and the nose, by way of an enclosed space defined between the mask body and the user's head. |
| Efficiency in respiration | low, as a result of residual amount of exhaled air in the tube. | high |
| Vision | most probably obscured by the transparent portions which may be spotted with water droplets resulted from mist within the enclosed space between the mask body and the user's head. | as clear as usual for the mist within the enclosed space is brought away by the exhaled air through the air exiting hose. |
| Physiological sensation at the mouth | unpleasant muscle strain around the mouth, in which the tube is held. | no abnormal strain. |
| Physiological sensation in the | thirst and dry, mostly by dry, non-humidified air directly from the | Quite normal, because the inhaled air passing through the throat has |

TABLE 1-continued

| | comparison between this inventive mask and the prior art | |
|---|---|---|
| | Prior Art | This Invention |
| throat | environment. | been humidified by mucous membranes within the nose. |
| Drainage from inside of the mask body | by removing the mask body from the user's face. | Simply by operating the drainer. |
| Preparation for resuming the respiration after diving deep into the water | by blowing so fiercely with the mouth as to remove water clogging the tube. | by breathing out gently with the nose to actuate the top flap of the breather. |

From the above description, it is apparent that this invention has the following advantages:

1. allowing the user to breathe in a normal way:

Because the hoses (11, 12) are arranged independently to and from the user's nose for inhaling and exhaling, the user can breathe normally and efficiently when having emerged or swimming immediately under the water surface;

2. improving the vision of the user as compared with prior art:

Because the possible mist within the enclosed space between the mask body (10) and the user's head is taken away by the exhaled air through the air exiting hose (12), few or no water droplets are condensed from the mist onto the transparent portions of the mask body and so the user may have a clear view of the underwater scenery around, which is of great importance.

3. no unpleasant physiological sensation at the mouth and in the throat:

Because it is unnecessary for the mouth to hold the hoses (11, 12), no abnormal muscle strain around the mouth happens and, because the inhaled air has been humidified by mucous membranes within the nose, the user's throat will not feel thirsty or dry.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A snorkel diving mask allowing nasal breathing of a user, comprising:

a mask body (10) having a pair of transparent portions (100) for the eyes and a nose portion (101) situated between said transparent portions (100);

said mask body (10) being formed with a resilient peripheral edge (102) for watertight engagement with the facial skin of said user around the eyes and the nose and a head band (103) for maintaining said watertight engagement of said resilient peripheral edge (102) with said facial skin;

a pair of air admitting hoses (11) extending from opposite side areas of said mask body (10);

an air exiting hose (12) extending from said nose portion (101) of said mask body (10); and a breather (20) in connection and in fluid communication with said hoses (11, 12);

whereby said user may breathe in and out nasally when said breather (20) is above the surface of water.

2. The diving mask as claimed in claim 1, wherein said mask body (10) has a connector (104) extending from said head band (103) to attach said breather (20) to said mask body (10).

3. The diving mask as claimed in claim 1, wherein said mask body (10) has a pair of inlet ports (115) defined in said opposite side areas at where said air admitting hoses (11) are affixed to said mask body (10), and wherein a pair of inlet valve flaps (110) is arranged in said inlet ports (115) to selectively close and open said inlet ports (115).

4. The diving mask as claimed in claim 2, wherein said mask body (10) has an outlet port (134) defined in said nose portion (101) at where said air exiting hose (12) is affixed to said mask body (10), and wherein an outlet valve flap (120) is arranged in said outlet port (134) to selectively close and open said outlet port (134).

5. The diving mask as claimed in claim 1, wherein said breather (20) is configured into a hollow body provided with a lower frame (21), and wherein said hollow body defines a bottom orifice (22) in fluid communication with the interior of said lower frame (21) while said lower frame (21) receives a movable float (210) which has a top flap (211) adapted to selectively close and open said bottom orifice (22) of said hollow body.

6. The diving mask as claimed in claim 1 further including a drainer (13) formed on an outside of said mask body (10) for draining out water within said nose portion (101).

7. The diving mask as claimed in claim 6, wherein said drainer (13) has an opening (135) defined in a wall thereof and a mounting rod (136) situated in a center of said opening (135), and wherein a water-exiting flap (130) is fastened to said mounting rod (136) to selectively close and open said opening (135) of said drainer (13).

8. The diving mask as claimed in claim 1, wherein said breather (20) has an inner partition (200) dividing the interior of said hollow body into a first chamber in fluid communication with said air admitting hoses (11) and a second chamber in fluid communication with said air exiting hose (12), and wherein said inner partition (200) is arranged so that both of said chambers are in fluid communication with said bottom orifice (22) of said hollow body.

* * * * *